US006408581B2

(12) United States Patent
Monachino

(10) Patent No.: US 6,408,581 B2
(45) **Date of Patent: *Jun. 25, 2002**

(54) FOUNDATION ELEMENT, METHODS FOR THE CONSTRUCTION OF PREFABRICATED STRUCTURES INCLUDING THESE ELEMENTS, PARTICULARLY PREFABRICATED TUNNELS, AND PREFABRICATED STRUCTURES MADE BY THESE METHODS

(76) Inventor: Mosé Monachino, Via A. Doria 5, I-92014, Porto Empedocle (Agrigento) (IT)

( * ) Notice: Subject to any disclaimer, the term of this patent is extended or adjusted under 35 U.S.C. 154(b) by 0 days.

This patent is subject to a terminal disclaimer.

(21) Appl. No.: 09/908,368

(22) Filed: Jul. 18, 2001

Related U.S. Application Data

(62) Division of application No. 09/230,147, filed on Jan. 19, 1999.

(30) Foreign Application Priority Data

Jul. 17, 1996 (IT) ..... AG96A0002
Sep. 30, 1996 (IT) ..... AG96A0003

(51) Int. Cl.[7] ..... E04B 6/16; E04B 1/32

(52) U.S. Cl. ..... 52/247; 52/295; 52/297; 52/126.6; 52/88; 52/245.08

(58) Field of Search ..... 52/295, 296, 297, 52/247, 126.5, 126.6, 126.7, 88, 745.07, 745.08, 742.12

(56) References Cited

U.S. PATENT DOCUMENTS

| | | | |
|---|---|---|---|
| 109,886 | A | 12/1870 | Freeman |
| 1,074,268 | A | 9/1913 | Kelly et al. |
| 1,474,808 | A | 11/1923 | Zucco |
| 2,616,149 | A | 11/1952 | Waller |
| 3,195,852 | A | 7/1965 | Lundell |
| 3,286,972 | A | 11/1966 | Jackson |
| 3,397,494 | A | 8/1968 | Waring |
| 3,848,377 | A | 11/1974 | Mori |
| 4,094,110 | A | 6/1978 | Dickens et al. |
| 4,099,360 | A | 7/1978 | Outram |
| 4,817,353 | A | 4/1989 | Woods et al. |
| 4,972,641 | A | 11/1990 | Barrios |
| 4,972,646 | A | 11/1990 | Miller et al. |
| 4,987,707 | A | 1/1991 | Kiselev et al. |
| 5,505,033 | A | 4/1996 | Matsuo et al. |
| 5,524,405 | A | 6/1996 | Byrd |
| 5,533,835 | A | 7/1996 | Angelette |
| 5,586,417 | A | 12/1996 | Henderson et al. |

FOREIGN PATENT DOCUMENTS

| | | |
|---|---|---|
| EP | 0244890 | 11/1987 |
| EP | 568799 | 11/1993 |
| FR | 2330818 | 6/1977 |
| WO | 9207144 | 4/1992 |

*Primary Examiner*—Carl D. Friedman
*Assistant Examiner*—Brian E. Glessner
(74) *Attorney, Agent, or Firm*—Hayes Soloway P.C.

(57) ABSTRACT

A foundation element in the form of a rigid monolithic prefabricated frame which includes at least two opposite containing side walls and cross-members interconnecting the two side walls so as to form a casting through-cavity between these two walls. The frame is intended to be located on the ground with the interposition of adjustable support devices and is intended to receive a hardenable fluid binder material poured into its through-cavity and adapted to spread onto the ground between this and the side walls and to fill the cavity, encapsulating the cross-members and the iron rods or other connecting members for connecting a superstructure element. Also provided are prefabricated structures including prefabricated tunnels, with foundation elements formed by means of the said prefabricated frames.

14 Claims, 6 Drawing Sheets

FOUNDATION ELEMENT, METHODS FOR THE CONSTRUCTION OF PREFABRICATED STRUCTURES INCLUDING THESE ELEMENTS, PARTICULARLY PREFABRICATED TUNNELS, AND PREFABRICATED STRUCTURES MADE BY THESE METHODS

This Application is a divisional of U.S. application Ser. No. 09/230,147, filed Jan. 19, 1999.

BACKGROUND OF THIS INVENTION

The present invention relates firstly to a foundation element for supporting a superstructure element on substantially level ground.

BRIEF REVIEW OF THE PRIOR ART

In the construction of buildings both-by traditional methods of casting reinforced concrete and with the use of prefabricated elements, the foundation elements are, for the most part, also cast by a traditional method.

This method consists of assembling a form on flat, levelled ground, placing the necessary reinforcing bars in the form, including bars which project upwardly for connection to a superstructure element such as a pillar, casting sufficient concrete in the form so as to fill it, awaiting the setting and hardening of the concrete and finally revealing the foundation element by removing the components of the form.

This traditional method is slow and reguires a large workforce and is therefore expensive.

Use has also been made of prefabricated foundation elements in the form of monolithic blocks which are also placed on flat, levelled ground. This solution is known, for example, from U.S. Pat. No. 1,474,808. These prefabricated monolithic elements have the disadvantage of being very expensive to transport and move because of their considerable weight and considerable bulk.

Both these known methods require the ground on which the foundation elements are cast or placed to be not only perfectly flat but also perfectly horizontal, which is very expensive.

OBJECTS OF THE INVENTION

A first object of the present invention is to provide a foundation element which is much easier and quicker to put into use than prior art foundations and requires only rough levelling and flattening of the ground, all of which considerably reduces the costs of transport and execution.

SUMMARY OF THE INVENTION

According to the present invention this object is achieved by means of a foundation element characterised in that it includes a rigid, prefabricated, monolithic frame, including at least two opposite, confining side walls and cross-members interconnecting the two side walls so as to form a casting through-cavity between these walls which, in its condition of use, is downwardly and upwardly open, and in that the frame has adjustable support devices associated with each of the side walls for maintaining these walls at a height above the ground that is adjustable, the monolithic frame being intended to be placed on the ground with the interposition of the adjustable support devices and being intended to receive a settable fluid binder material into its through-cavity, the binder material being able to spill out onto the ground between this and the side walls and to fill the cavity so as to encapsulate the cross-members and iron bars or other connector members for connection to the superstructure element and, after hardening, to constitute a monolithic mass which connects the foundation element and the superstructure element permanently to the ground.

This solution enables a relatively light, monolithic frame for use as a non-recoverable form to be prefabricated, the frame being transportable at little cost from the factory to the construction site and, given its lightness, being movable equally cheaply on site. The ground at the construction site intended to receive the frame needs to be only roughly flattened and levelled since the final levelling of the frame may be achieved after it has been laid by suitable manipulation of the adjustable support devices with the aid of spirit levels or more advanced systems such as modern satellite positioning systems.

In view of the adjustable support devices, a space is left between the levelled framework and the ground through which the fluid concrete or other binder material may spread out of the frame, thereby widening the base for the latter.

The binder material, in spreading out over the ground, adapts to its morphology and ensures an extremely good distribution of the load over the support surface.

After hardening, the frame and the binder material constitute a monolithic foundation element.

Moreover since those surfaces of the foundation element thus formed which are open to view are constituted by parts of the frame, which is prefabricated, these surfaces may have a finished appearance from the start.

As the rigid monolithic frame is itself mechanically strong, it is able to support a superstructure element for an indefinite period of time before its cavity is filled with the binder. material.

A foundation element according to the invention enables a method to be carried out, according to the invention itself, for the construction of a prefabricated structure which is characterised by the following operations:

- the placing of the rigid monolithic frame of the foundation element on the ground with the interposition of the adjustable support device between the frame and the ground;
- the levelling of the frame by adjustment of its support devices;
- the connection of the frame and the superstructure element at least by means of a connecting reinforcement fixed, on the one hand, to the superstructure element and, on the other hand, inserted in the frame;
- the casting of a hardenable fluid binder material in the cavity in the frame so that this fluid material, after having spread over the ground beneath the frame, fills the cavity of the frame and encapsulates therein cross-members of the latter and the connecting reinforcement;
- the hardening of the binder material to obtain a monolithic unit comprising the base element and the superstructure element.

The invention also relates to a prefabricated structure made by this method.

The invention lends itself ideally to the construction of a prefabricated artificial tunnel.

Methods for the construction of prefabricated artificial tunnels on levelled ground constituted by the bottom of a cutting are already known from U.S. Pat. No. 109,886 and EP-A-0 244 890, these tunnels subsequently being covered with earth and being Of the type in which the tunnel is formed from consecutive inverted U-sections, each of which includes prefabricated lateral superstructure elements in the form of piers and a prefabricated upper element in the form of an arch resting on the tops of the piers.

In methods known from these documents, the tunnel sections include a prefabricated bed which interconnects the piers as well as the two piers and the arch.

The method of the invention is characterised in that in order to constitute each of the consecutive sections, there is used, in addition to the prefabricated elements in the form of piers and an arch, a pair of foundation elements each of which is of the type claimed, and in that the tunnel section is made by the following operations:

- the laying of two rigid monolithic frames on the ground on opposite sides of the bottom of the cutting, each with the interposition of the said adjustable support devices between the frame and the ground;
- the levelling of the two frames by adjustment of their adjustable support devices;
- the connection of each frame and its pier at least by means of a connecting reinforcement fixed, on the one hand, to the pier and, on the other hand, inserted in the frame;
- the casting of a hardenable fluid binder material in the cavity in the frame so that this fluid material, after spreading over the ground beneath the frame, fills the cavity in the frame and encapsulates the cross-members of the latter and the connecting reinforcement;
- the hardening of the binder material to obtain a monolithic unit comprising the base element and the pier;
- the placing of the arch on the two piers.

This method does not require the use of a prefabricated bed since the two foundation elements do not require prior interconnection to stabilise the structure since they are firmly anchored to the ground.

The tunnel may subsequently be completed by a bed cast by conventional methods, even after the tunnel has been covered with the layer of earth.

The invention also relates to an artificial tunnel made by a method according to the invention and, in particular, to an artificial tunnel characterised in that the piers and the arch are articulated together by joints which each comprise a longitudinal channel of arcuate section and a longitudinal rib of corresponding arcuate section, formed along the adjoining edges of the pier and of the arch, and in that the permanent connecting elements of each articulation are in the form of tie rods which substantially intersect the longitudinal axis of articulation of the joint.

An artificial tunnel which includes couplings having the said configuration and permanent connecting elements is known from EP-A-0 244 890.

In this document, the permanent connecting elements are constituted by tie rods which extend tangentially on the exterior of the structure and which permanently lock the joints so as to prevent mutual pivoting in the finished structure.

This locking of the articulations renders the artificial tunnel according to the document EP-A-0 244 890 unsuitable for use in seismic regions, on unstable ground and where they are subject to unilateral forces resulting from asymmetric external loads, whether permanent-or occasional.

The use of tie rods which substantially intersect the longitudinal axis of articulation of the joint however enables an artificial tunnel to be made in which the elements are always articulated together so that they can always pivot relative to each other about the longitudinal axis just as their rotoidal coupling is always ensured, even under the action of external horizontal and sussultatory forces. The tunnel is thus suitable for use in seismic regions or on unstable ground.

Throughout the present description and in the claims, the term "artificial tunnel" is used conventionally to indicate a tunnel proper, for example a road or rail tunnel, or a structure with a relatively small section such as a drainage culvert or other underground duct or water conduit or the like.

BRIEF DESCRIPTION OF THE DRAWINGS

The invention will be more clearly understood from a reading of the detailed description which follows, made with reference to the appended drawings, given purely by way of non-limitative example and in which.

DETAILED DESCRIPTION

Figure 1:
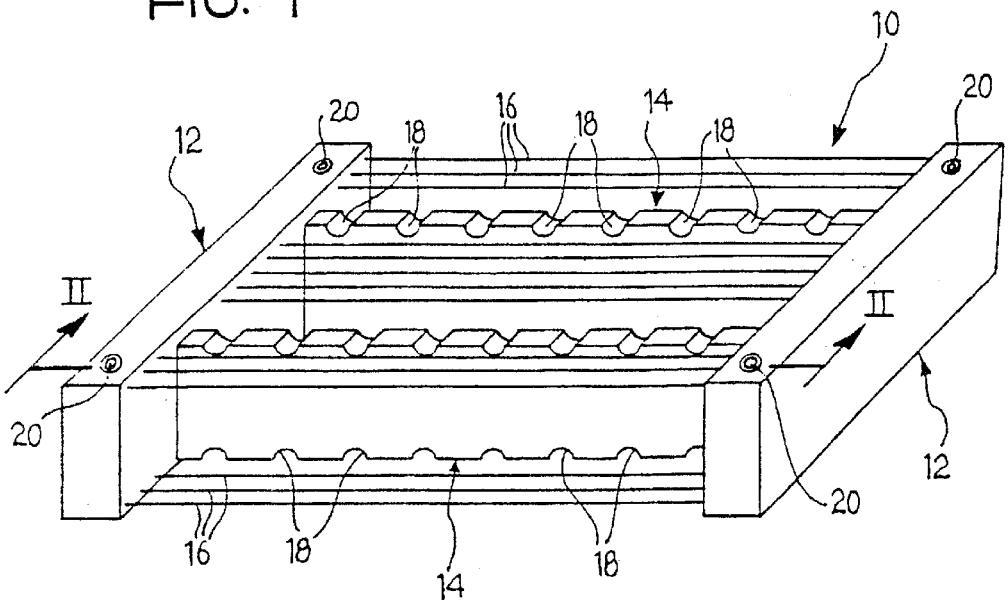
FIG. 1 is a perspective view of a prefabricated frame intended to constitute a foundation element according to a first embodiment of the invention.
Figure 2:
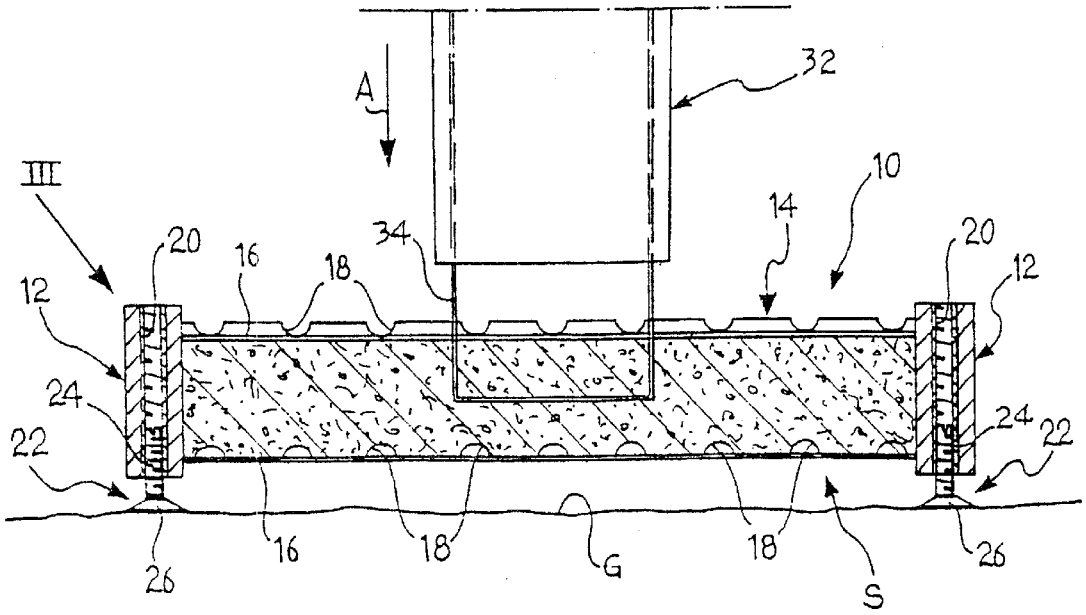
FIG. 2 is an elevational view in which the frame of FIG. 1 is shown sectioned in the transverse plane indicated II—II in FIG. 1 and in which part of a superstructure element being positioned on the frame is shown.

With reference to FIGS. 1 and 2, a rigid, prefabricated, monolithic frame is generally indicated 10.

The frame 10 is preferably of vibrated reinforced concrete or other suitable reinforced conglomerate.

The frame 10 includes, integrally, two opposite, containing side walls 12 and a pair of cross-members 14 interconnecting the two walls 12.

The two walls 12 are also interconnected by cross-members in the form of reinforcing iron rods 16, the ends of which are anchored in the walls 12 during their manufacture.

Preferably, as shown, the two cross-members 14 are spaced inwardly from the ends of the side walls 12 so as to give the frame 10 a double-H shape in plan, with the side walls 12 corresponding to the legs and each cross-member 14 corresponding to one of two parallel cross-arms.

The advantage of this double-H arrangement will be clarified below.

The upper-and lower edges of the two cross-members 14 have sets of aligned, semi-circular notches 18 which, as will be clarified below, serve to house iron rods for connecting several frames 10 laid in alignment.

Internally-threaded tubular inserts 20 are embedded in the end regions of the side walls 12.

The tubular inserts 20 form parts of adjustable support devices generally indicated 22.

A preferred embodiment of these support devices will be described with reference to FIG. 3.

The adjustable support devices 22 are provided in the ratio of two devices 22 for each of the opposite side walls 12. Each device 22 is located close to one of the ends of the respective side wall.

Figure 3:
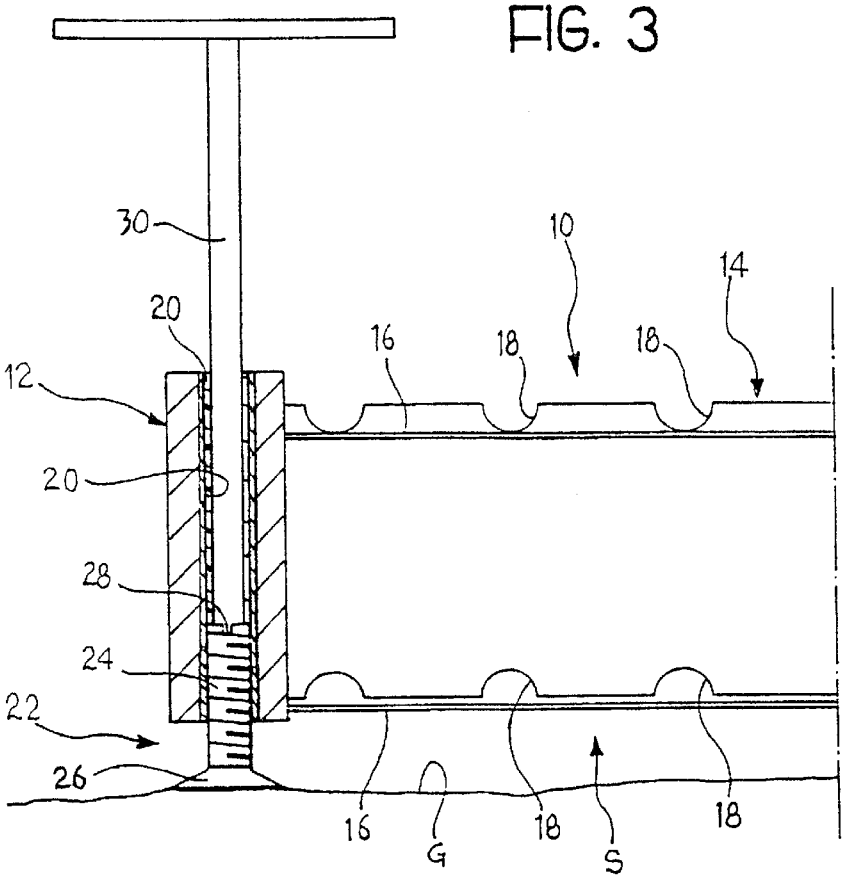
FIG. 3 is a partial section showing, on an enlarged scale, the part indicated by the arrow III in FIG. 2 and equipment for operating an adjustable support device incorporated in the frame.

With reference to FIG. 3, the tubular insert 20 constitutes the nut of a jackscrew.

The screw of the jack is constituted by a threaded shaft 24 which has a foot 26 rotatably coupled to its lower end.

The upper end of the threaded shaft 24 serves as an operating head and has a transverse notch 28 or other suitable formation engageable by a correspondingly-shaped end of an operating tool 30 in the form of a T-shaped wrench, the shank of which is inserted in the tubular insert 20 from above.

Figure 4:
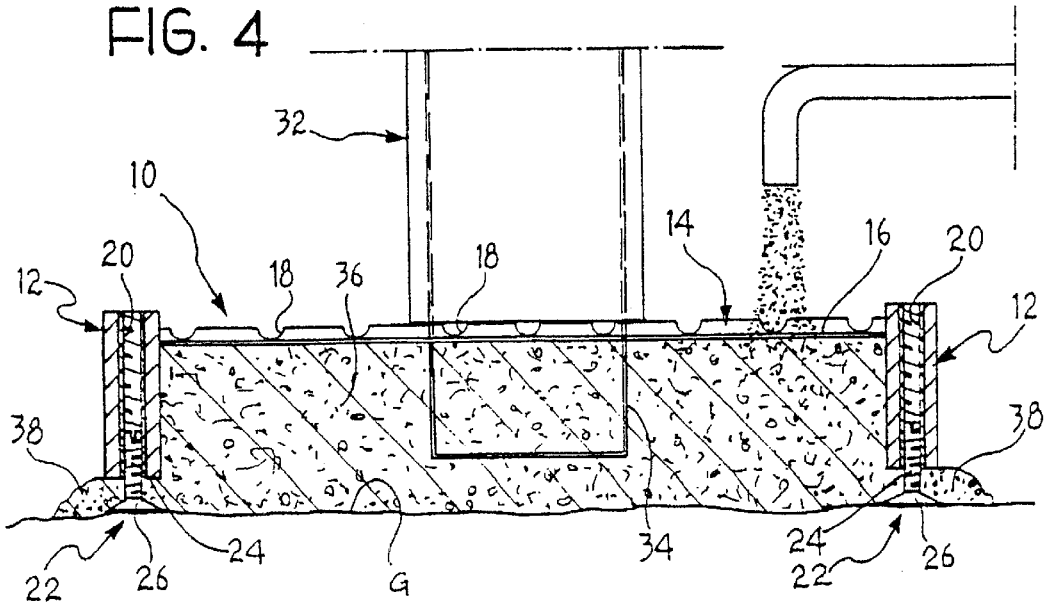
FIG. 4 is a representation similar to that of FIG. 2 in which the superstructure element has been positioned on the frame and a binder material is being cast in the cavity of the frame itself.

In FIGS. 2 to 4, the profile of the ground on which the frame 10 has been placed in use is indicated G.

The ground G has been flattened and levelled rather roughly, and may even have a slope, before the laying of the frame 10.

After the frame 10 has been laid, as shown in FIG. 2, it is levelled by adjustment of its support devices 22 with the aid of the T-shaped wrench as indicated at 30 in FIG. 3 or an equivalent tool.

The frame 10, even after levelling, remains at a certain height from the ground G so as to define a space S beneath the side walls 12 and the cross-members 14.

The frame 10, thus levelled, is, ready to receive a prefabricated superstructure element indicated generally at 32 in FIGS. 2 and 4.

The superstructure element 32 may be any prefabricated element, such as a pier or pillar, a wall portion or the like.

In each case the superstructure element has iron rods 34 projecting from its underside which constitute a connecting reinforcement which, when the element 32 is lowered in the direction of the arrow A of FIG. 2, are inserted in the through-cavity defined between the cross-members 14 and the transverse rods 16 in the frame 10.

In the final position of the element 32, illustrated in FIG. 4, its lower face rests on the cross-members 14.

In this condition the superstructure element 32 may remain temporarily supported by the frame 10.

Once the superstructure element 32 has been laid as shown in FIG. 4, the through-cavity defined by the frame 10 is filled with a cement conglomerate or other fluid binder 36 which spreads out of the space S and under the containing walls 12 and the cross-members 14 (FIGS. 2 and 3), as indicated at 38.

The binder material 36, once hardened, anchors the foundation element thus formed firmly to the ground G and connects the frame 10 and the superstructure element 32 together in a monolithic block.

Figure 5:
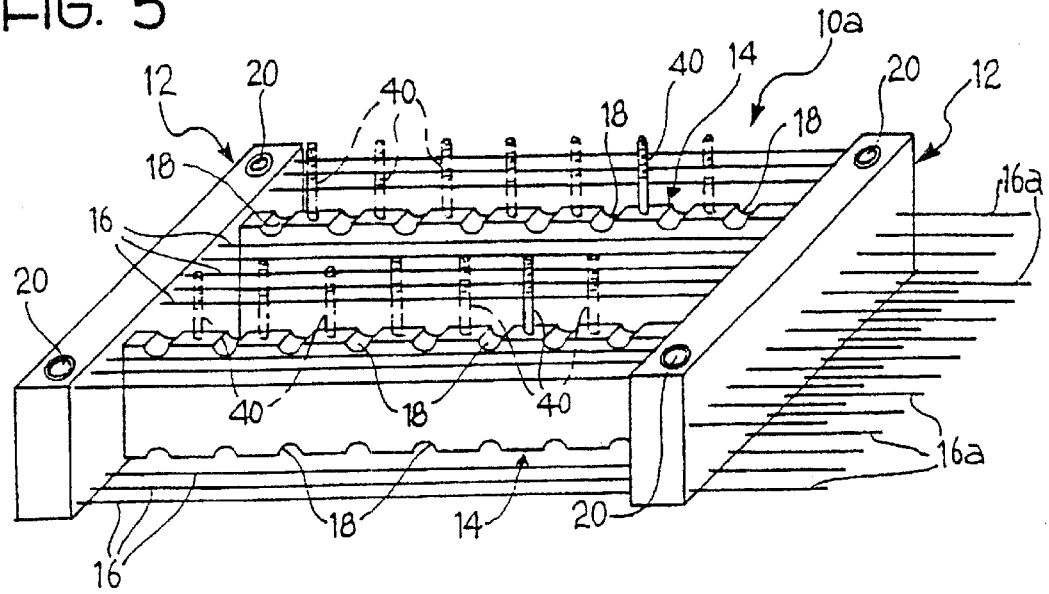
FIG. 5 is a perspective view similar to FIG. 1, showing a monolithic frame according to another embodiment of. the invention.
Figure 6:
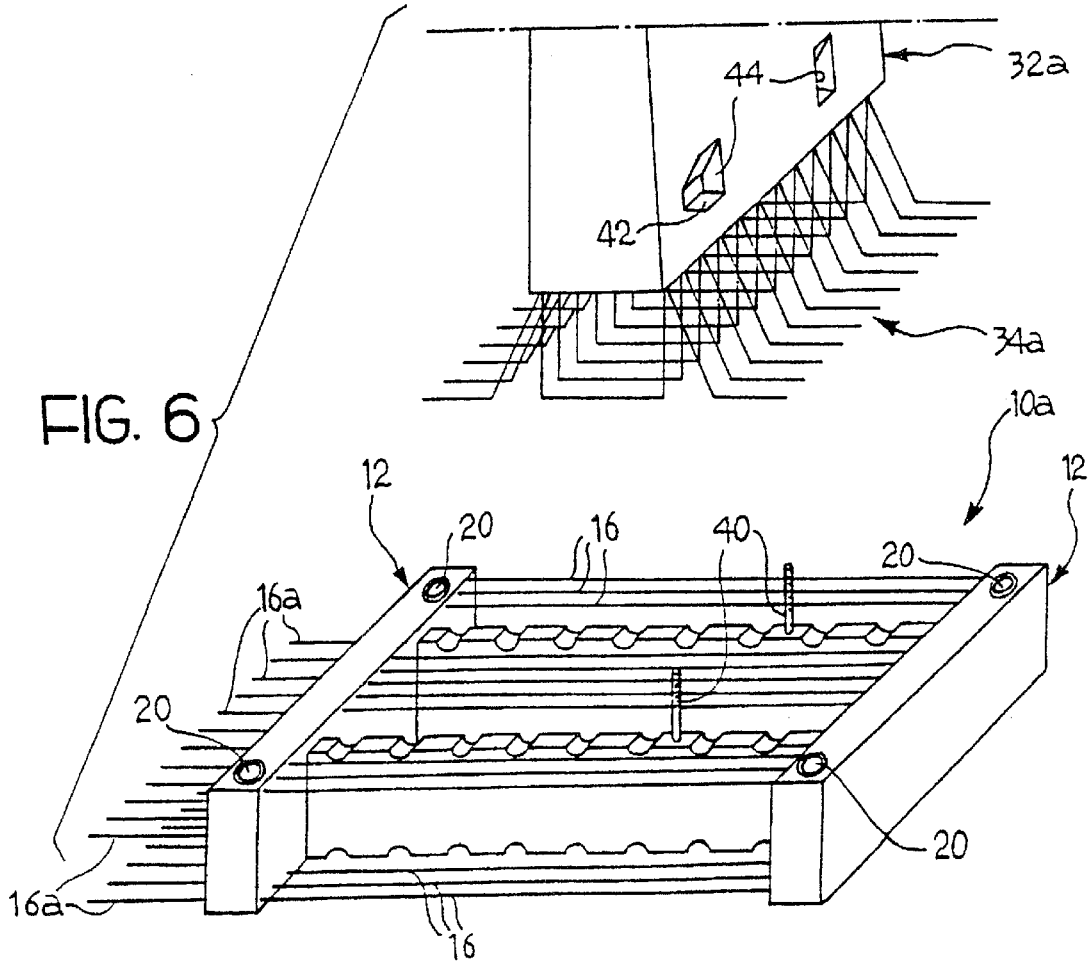
FIG. 6 is a perspective view showing the frame of FIG. 5 and part of a superstructure element, partly cut-away, while being lowered on to the frame.

FIGS. 5 and 6 illustrate a frame having characteristics similar to those of the frame 10 of FIGS. 1 and 2.

This frame is-generally indicated 10*a*.

Parts substantially identical to those of the frame 10 of FIGS. 1 and 2 are generally indicated by the same reference numerals and their description will not be repeated.

The frame 10*a* has means for fixing it temporarily to a superstructure element part of which is illustrated in FIG. 6 where it is generally indicated 32*a*.

In a preferred embodiment, the temporary fixing means with which the frame 10*a* is provided consist of threaded columns 40 incorporated in the cross-members 14 and which, in use, project upwardly to enable the superstructure element 32*a* to be fixed by bolting.

Each cross-member 14 may have one or more threaded columns 40. which project from its upper face into the spaces between the notches 18.

In FIG. 5 all the possible positions of the threaded columns 40 are illustrated in broken outline except for one position for each cross-member 14 which is illustrated in continuous outline to specify a selected position corresponding to that of the superstructure element 32*a* of FIG. 6, as well, as will be described below, as superstructure elements in the form of piers for prefabricated artificial tunnel sections.

The frame 10*a* of FIGS. 5 and 6 differs from the frame 10 of FIGS. 1 and 2 in that at least some of the iron reinforcing rods 16 project from the periphery of the frame 10*a* to enable the foundation element to be connected to contiguous structures. More particularly, in the embodiment of FIGS. 5 and 6, the reinforcing rods 16 have appendages 16*a* which project outwardly from one of the side walls 12.

As in the case of the superstructure element 32 of FIGS. 2 and 4, the superstructure element 32*a*, which may be a pillar, pier, a portion of a wall or the like, has a complex of rods 34*a* projecting from underneath to constitute a connecting reinforcement.

Figure 8:
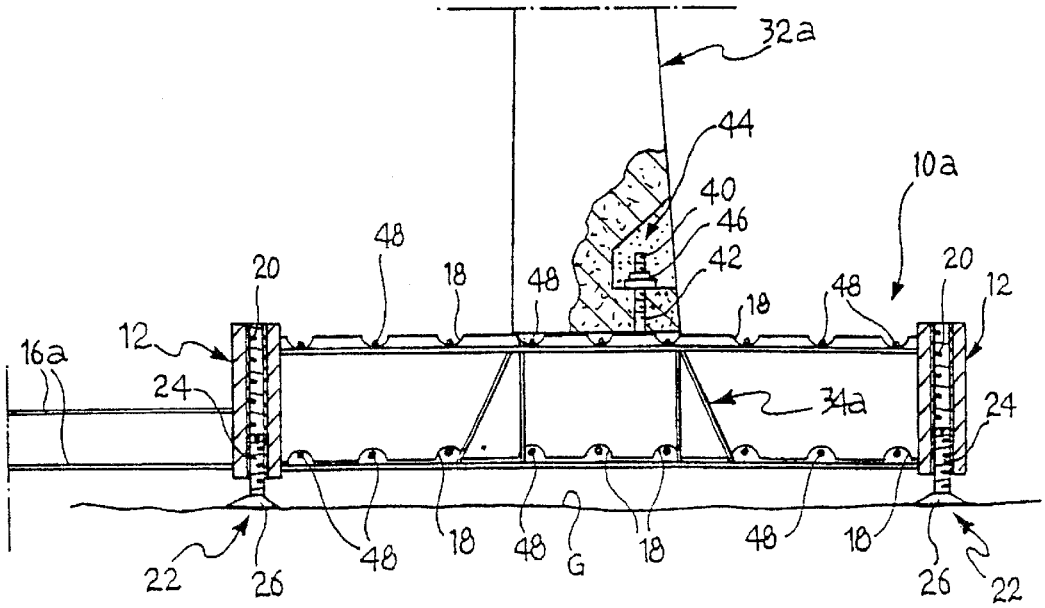
FIG. 8 is an elevational view in which the frame of FIGS. 5 and 6 is shown sectioned in the same manner as in FIG. 2, and which illustrates a superstructure element, partly in section, in its position resting on the frame.

Moreover, as illustrated in. FIGS. 6 and 8, two holes 42. extend from the lower faces of the elements 32*a* and open into recesses 44 formed in one side of the element 32*a*.

The holes 42 are so arranged that, when the superstructure element 32*a* is coupled with the frame 10*a*, the connecting rods 34*a* are inserted in the through-cavity defined by the frame 10*a* between the cross-members 14 and the transverse rods 16 and, at the same time, the threaded columns 40 are fitted into the holes 42 and their threaded ends project into the recesses 44.

With the superstructure element 32*a* fitted onto the corresponding edges of the cross-members 14, the frame 10*a* and the superstructure element 32*a* may be made rigid with each other by means of nuts 46 screwed onto the columns 40. The temporary connection formed by means of the threaded columns 40 or equivalent mechanical connection means not only allows the superstructure element 32*a* to be fixed temporarily to a frame 10*a* when this has already been placed in its position of use and possibly already levelled, but also forms a rigid unitary unit, comprising the frame 10*a* and the element 32*a*, which can be made in a place other than that in which it is to be put to use, for example in a zone separate from the construction site.

This unit may then be placed in its position of use, all together, by means of a suitable machine such as a crane.

Figure 7:
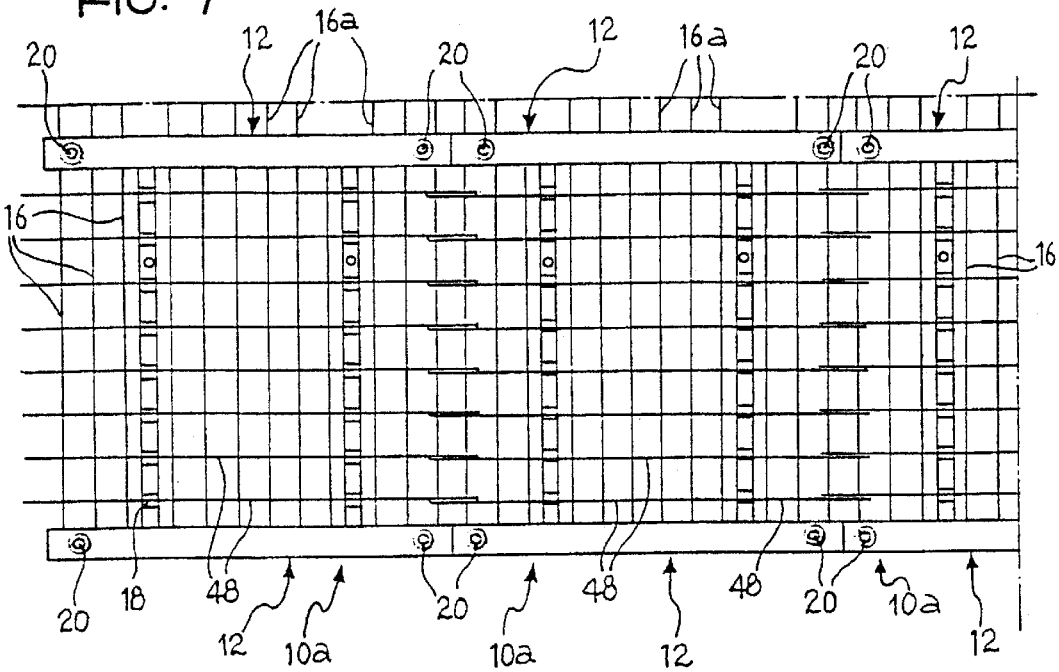
FIG. 7 is a plan view showing several similar frames laid in alignment in use.

FIG. 7 illustrates the advantageous possibility of providing several frames in alignment, without discontinuities between their side walls 12.

This possibility also exists in the case of the frame 10 of FIGS. 1 and 2.

To ensure firm connection between the aligned frames 10*a* when these are placed in their positions of use, both before and after levelling, they are linked by two webs, an upper and lower one, of longitudinal, iron connecting rods 48 which are housed in the notches 18.

Although this is not shown in FIG. 7, one may suppose that a superstructure element 32*a* has already been fixed temporarily to each frame 10*a*, or a common superstructure element 32*a* has been fixed to several frames 10*a*.

After one or more frames 10*a* have been laid and levelled and one or more superstructure elements 32*a* have been fixed in the configuration shown in FIG. 8, the cement conglomerate or other binder material is then cast in the manner described with reference to FIG. 4.

As may be seen from FIG. 7, by virtue of the double-H shape of the frames 10*a*, further through-cavities are defined between the adjoining frames 10*a* for receiving a fluid binder such as a cement conglomerate.

A method of construction such as that described lends itself ideally to the production of a prefabricated artificial tunnel.

Figure 9:
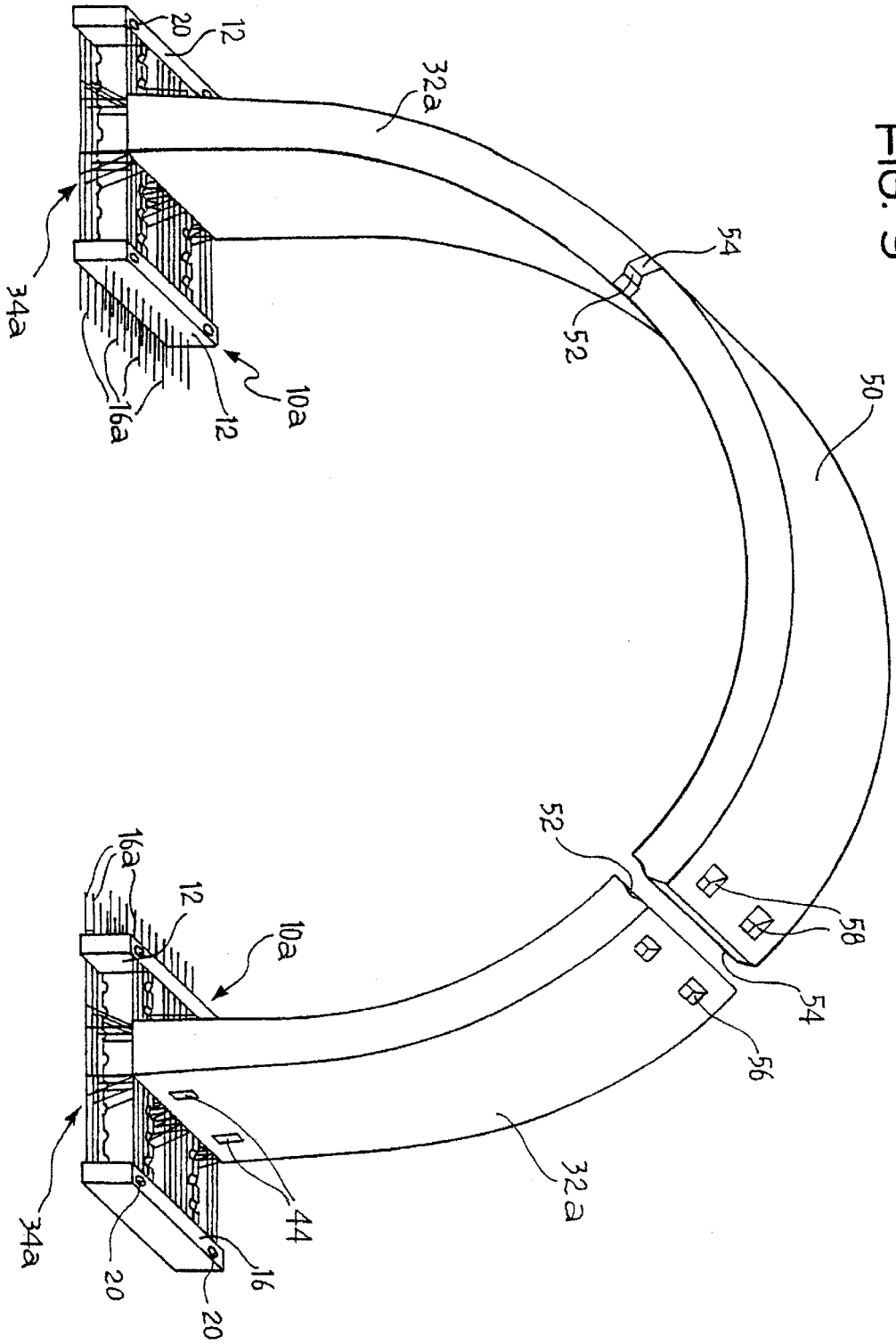
FIG. 9 is a perspective view showing a section of a prefabricated tunnel during assembly.

FIG. 9 shows the elements which make up a section of a prefabricated artificial tunnel in a disconnected condition.

For simplicity, the two piers of the tunnel section, which constitute the superstructure elements considered above, are again indicated 32*a* and their frames are again indicated 10*a*.

The tunnel section is completed by a prefabricated upper element in the form of an arch, generally indicated 50.

The means for coupling and interconnecting each pier 32*a* with its arch element 50 will be described below.

To construct each artificial tunnel section, the ground is first excavated in the usual manner to form a cutting (not shown) the bottom of which is flattened and levelled roughly.

Subsequently, for each gallery section, two frames 10*a* are laid on the ground on opposite sides of the bottom of the cutting in the arrangement illustrated in FIG. 9.

It is understood that each frame 10*a* is laid with adjustable support devices interposed between the frame and the ground, for example, devices such as that illustrated in FIG. 3.

The two opposing frames 10*a* are then levelled in the manner described above by means of the adjustable support devices.

As described with reference to FIG. 8, the,piers 32*a* are then placed on the frames 10*a* which have already been laid and possibly levelled previously, or may be fixed temporarily to each frame 10*a* in a zone separate from the construction site and are then placed in the position of use together with their frames 10*a*.

These operations may be carried out for each individual tunnel section being constructed or for a group of consecutive sections.

Figure 10:
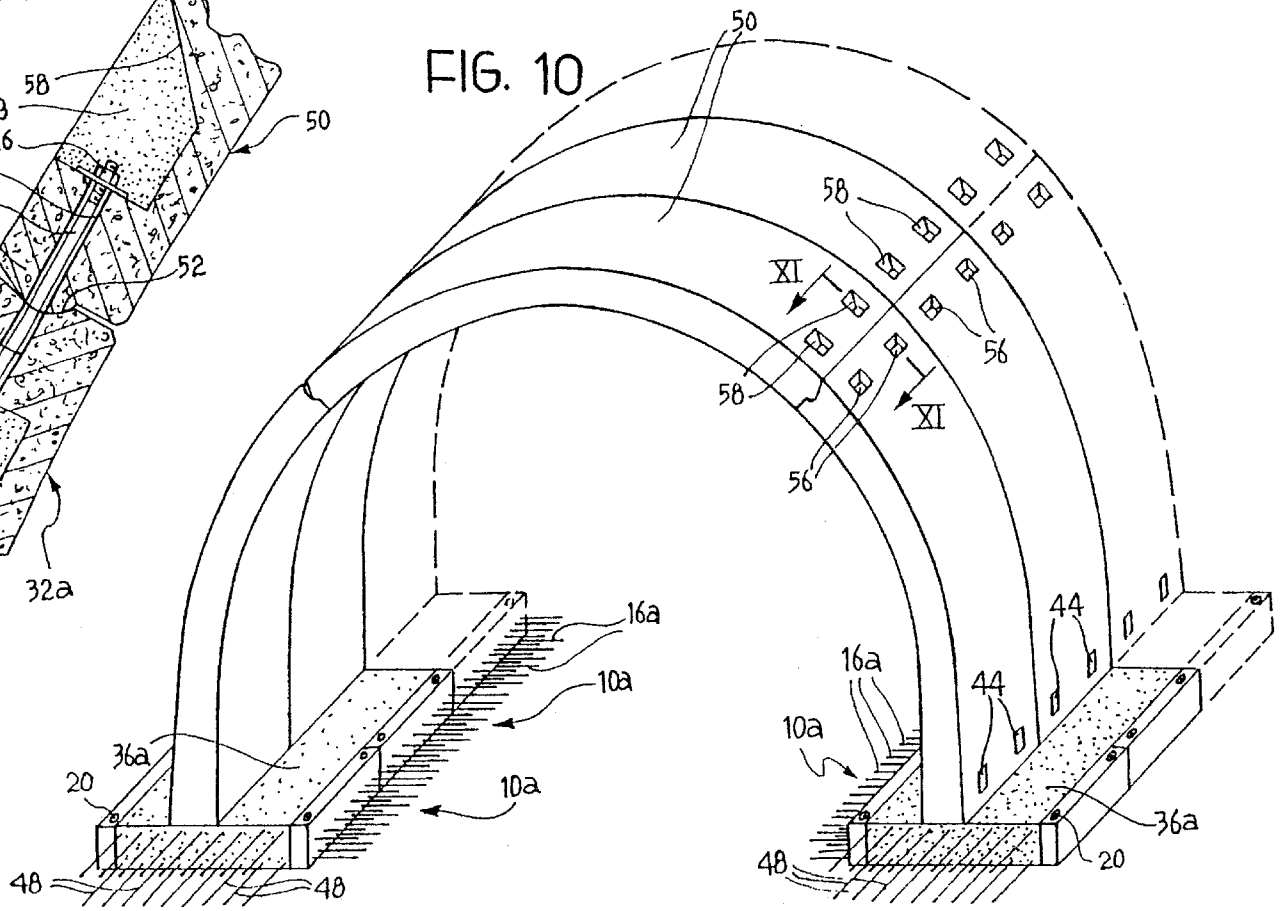
FIG. 10 is a perspective view showing several sections of the prefabricated tunnel after assembly.

With the frames 10*a* and the piers 32*a* laid and positioned correctly, the cement conglomerate or other binder material is then poured in as illustrated at 36*a* in FIG. 10.

As a final phase for each section, an arch element 50 is placed on the top of the two opposite piers, as illustrated in FIG. 10.

To advantage, the adjoining edges of the piers 32*a* and the arch 50 in each section are articulated together by joints.

Figure 11:
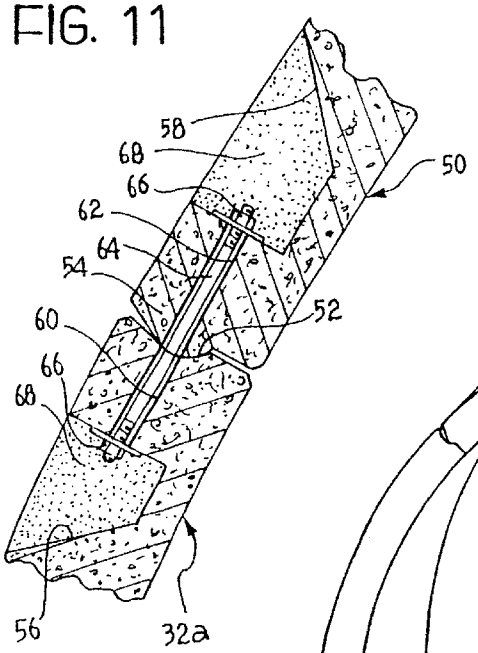
FIG. 11 is an enlarged transverse section taken on the plane indicated XI—XI in FIG. 10.

A preferred configuration of one of these articulated joints is illustrated in FIG. 11.

The upper longitudinal edge of each pier 32*a* is formed with an arcuate-section longitudinal channel; a longitudinal rib 54 of corresponding arcuate section is formed on the corresponding longitudinal edge of the arch element 50.

The arrangement of the mutual articulation formations may be reversed, that is to say, the pier 32*a* may have an arcuate rib and the arch 50 may have a corresponding arcuate channel.

The pier 32*a* and the arch 50 are formed with respective recesses 56, 58 which open into their extradotal surfaces in the zones adjacent the joint.

Respective holes 60, 62 extend from these recesses 56, 58, through the pier 32*a* and the arch 50 respectively to open into the bottom of the channel 52 and the top of the rib 54 respectively.

When the mutual articulation formations constituted by the channels 52 and ribs 54 are coupled as shown in FIG. 11, the holes 60, 62 are aligned.

A tie rod in the form, of a threaded bar 64 is fitted into the pair of aligned holes 60, 62, and finally clamping nuts 66 are screwed onto its two ends and tightened.

As will be seen, the aligned holes 60, 62 extend tangentially within the adjoining portions of the pier 32*a* and the arch 50 and, with this arrangement, the tie rod 64 substantially intersects the longitudinal axis of articulation of the joint.

This ensures the rotoidal coupling of the piers 32*a* and the arches 50, with the advantages explained in the introduction to the present description.

Once the tie rods 64 have been tensioned by means of their nuts 66, the recesses 56, 58 are filled with a sealing material 68, for example a cement mortar.

When the structure of the artificial tunnel has been completed, it is covered in the usual manner with a covering of earth, preferably after it has been water-proofed.

As may be seen in FIG. 10, the appendages 16*a* of the iron reinforcements project inwardly of the tunnel from the individual frames 10*a*.

The projecting appendages 16*a* of the rods serve to fix a plate, for example a road bed, to the frames 10*a*, it being possible to cast the bed in the conventional manner before or after the tunnel is covered with earth.

What is claimed is:

1. A foundation element for supporting a superstructure element on substantially flat ground, said foundation element comprising a rigid, prefabricated, monolithic frame, including at least two opposite, containing side walls and cross-members interconnecting the two side walls to form a casting through-cavity between the two side walls, wherein said frame comprises a prefabricated element of reinforced conglomerate, and wherein the side walls and the cross-members are formed integrally with the side walls, said frame further comprising at least two transverse iron bars spaced from and parallel to each other and the cross-members, the ends of which bars are anchored in the side walls, said frame having adjustable support devices associated with each of the side walls for adjusting the walls at a height above the ground, whereby said monolithic frame may be placed on the ground supported on the adjustable support devices for receiving a hardenable fluid binder material in its through-cavity, whereupon binder material is able to spill out onto the ground between the ground and the side walls and to fill the cavity so as to encapsulate the cross-members and any connector members supported on and projecting from said cross-members for connection to the superstructure element, which, after hardening forms, with said monolithic frame, a monolithic mass which connects the foundation element and the superstructure element permanently to the ground.

2. A foundation element according to claim 1, wherein said rigid monolithic frame, in plan has the shape of a double H with the side walls corresponding to legs of the H and the two cross-members corresponding to two parallel transverse arms of the H.

3. A foundation element according to claim 1, wherein at least some of the iron bars project from the periphery of the frame to constitute appendages for connecting the foundation element to contiguous structures.

4. A foundation element according to claim 1, wherein the adjustable support devices are provided in a ratio of two devices for each of the opposite side walls, each of the devices being located close to one of the ends of a respective side wall.

5. A foundation element according to claim 1, wherein each adjustable support device includes a foot.

6. A foundation element according to claim 5, wherein each foot forms part of a jackscrew which includes, on the one hand, a threaded shaft extending substantially perpendicular to the ground in use, and carrying the foot at its lower end and an operating head at its upper end, and, a cooperating female threaded member fixed to the side wall.

7. A foundation element according to claim 1, wherein each adjustable support device includes a female member in the form of an internally-threaded tubular insert which is incorporated in a respective side wall.

8. A foundation element according to claim 1, wherein the frame includes a fastener for temporary fixing to a superstructure element having a cooperating fastener.

9. A foundation element according to claim 1, wherein threaded columns are incorporated in the cross-members and project upwardly therefrom, for fixing to a superstructure element by bolting.

10. A method for the construction of a prefabricated structure including at least one foundation element and a superstructure element, of which the foundation element is laid on substantially leveled ground and the superstructure element is supported by the foundation element, comprising the steps of:

(a) providing a foundation element as claimed in claim 1;

(b) placing the rigid monolithic frame of the foundation element on the ground with the interposition of the adjustable support devices between the frame and the ground;

(c) leveling of the frame by adjusting the support devices;

(d) connecting the frame and the superstructure element at least by means of a connecting reinforcement fixed to the superstructure element and inserted in the frame;

(e) casting a hardenable fluid binder material in the cavity of the frame so that this fluid material, after having spread over the ground beneath the frame, fills the cavity of the frame and encapsulates the cross-members of the latter and the connecting reinforcements; and (f) hardening the binder material to obtain a monolithic unit comprising the frame, the foundation element and the superstructure element.

11. A method of construction according to claim 10, wherein a superstructure element and a frame are used which have mutual mechanical connectors and, before the casting of the hardenable binder material, the frame is connected temporarily to the foundation element by these connectors.

12. A method of construction according to claim 11, wherein the frame and the superstructure element are interconnected temporarily before the laying of the frame, the combination of the frame and the superstructure element which are temporarily interconnected then being laid together on the ground, and the binder material is cast after the leveling of the frame.

13. A monolithic unit comprising a base element and a superstructure element made by a method according to claim 10.

14. A structure including at least one monolithic unit according to claim 13.

* * * * *